United States Patent [19]

Ishikawa et al.

[11] 4,085,174

[45] Apr. 18, 1978

[54] PROCESS FOR SPINNING MODIFIED SYNTHETIC FIBERS

[75] Inventors: Tatsuo Ishikawa; Keiji Yamashita; Norio Okubo; Masahira Sakashita; Arimichi Okamoto; Tetsuhiro Kusunose, all of Nobeoka, Japan

[73] Assignee: Asahi Kasei Kogyo Kabushiki Kaisha, Osaka, Japan

[21] Appl. No.: 642,027

[22] Filed: Dec. 18, 1975

Related U.S. Application Data

[63] Continuation of Ser. No. 494,255, Aug. 2, 1974, abandoned.

[30] Foreign Application Priority Data

Dec. 24, 1970 Japan ..... 45-116657
Dec. 24, 1970 Japan ..... 45-116658

[51] Int. Cl.[2] ..... B29H 7/20

[52] U.S. Cl. ..... 264/49; 264/171; 264/173; 264/209; 428/398

[58] Field of Search ..... 264/171, 173, 209, 49; 428/398; 210/500 M

[56] References Cited

U.S. PATENT DOCUMENTS 3,781,399 12/1973 Kobayashi et al. ..... 264/171

FOREIGN PATENT DOCUMENTS 44-3505 2/1969 Japan ..... 264/171
43-4540 2/1968 Japan ..... 264/171

*Primary Examiner*—Jay H. Woo
*Attorney, Agent, or Firm*—Sughrue, Rothwell, Mion, Zinn and Macpeak

[57] ABSTRACT

Synthetic fibers capable of absorbing aqueous medium are manufactured by simultaneously extruding the fiber material and a second material in a core and sheath arrangement. Turbulence is produced in the zone where these two materials combine which results in undulations in their cross-sections. The second material is then dissolved away with a solvent to leave a fiber with an undulating surface. When the second material is extruded as the core, the fiber is hollow with undulations on the inside while when the second material is extruded as the sheath the solid fiber has an undulating outer surface.

5 Claims, 5 Drawing Figures

PROCESS FOR SPINNING MODIFIED SYNTHETIC FIBERS

This is a continuation of Ser. No. 494,255 filed Aug. 2, 1974, now abandoned.

This invention relates to physically improved, modified and conditioned synthetic fibers and a process for the manufacture of same.

The synthetic fiber has, generally speaking only a poor aqua-absorbing power. As an example, nylon fibers may pick up aqueous medium in the order of only 7 - 8% of their own weight and thus underwears made from such fibers as nylon can pick up only a small amount of sweat from the wearer who suffers thus from his unpleasant and unsanitary feelings during his or her wearing period. This drawback is fatal to this kind of fibers and constitutes an appreciable braking factor to a more broad and accelerated use of these fibers, as is well known among both skilled and unskilled persons.

In addition, the synthetic fibers have generally appreciable waxy looks and feelings, as is highly well known.

Regenerated fibers such as rayon fibers are rather superior over the synthetic fibers in this respect, but they are defective in such that the spinning velocity for these regenerated fibers amounts only to one severalth of that for the representative synthetic fibers such as nylon. Therefore, it is a general tendency that the regenerated fibers are gradually overwhelmed by the synthetic fibers.

In order to improve or obviate the aforementioned lower pick-up rate of aqueous medium by the synthetic fibers, foam yarns have already proposed. These improved fibers are manufactured in such a way that a proper foaming agent such as sodium hydrogencarbonate, ammonium carbonate, amyl acetate, butyl acetate or diazoaminobenzene is admixed before spinning to the spinning material and the thus modified material is extruded from a spinneret. In this way, the aqueous pick-up rate of the synthetic fiber can be substantially improved, in addition to the simultaneous reduction of the defective waxy feelings by forming an infinitely large number of finely distributed random depressions on the surface of the fiber. At the same time, however, fine gas-filled cells are formed within the whole material of the fiber, thereby the tensile strength thereof being naturally and defectively reduced.

The main object of the present invention is to provide a synthetic fiber devoid of the aforementioned various conventional drawbacks inherent in the synthetic fibers, and a process for the manufacture of same.

A further object is to provide an improved and modified synthetic fiber having a silk-like glaze and feeling, and a process for the manufacture of same.

Almost all of conventional synthetic fibers, except specially prepared one for specific purpose, have a smooth surface which invites a high thermal conductivity and thus a low performance of heat preservation.

It is, therefore, a further object of the invention to provide a synthetic resin having a substantially increased overall surface area for improving the heat preserving capability over the conventional corresponding synthetic fibers, and a process for the manufacture of same.

In this respect, conventional foam fibers can satisfy substantially the last-mentioned object of the invention. However, when a substantially fine yarn, less than 50 denier by way of example, frequent yarn breakage could be encountered. A still finer yarn, for instance 5 denier or less, can not be produced by the conventional foam yarn technique without fear of frequent yarn breakage.

It is, therefore, a still further object of the present invention to provide a multifilament of the kind above referred to, composed of fine individual constituent filaments, each of which may have a fine denier such as 5 denier or less when required, and a process for the manufacture of same.

In order to fulfil the aforementioned objects, the improved and modified synthetic fiber according to this invention has at an outer or inner surface thereof a specific undulated cross-sectional configuration similar to that which is owned by the regular and conventional layon. These undulations are formed and arranged on the inside or outside surface of the fiber, as the case may be, in random manner when seen in the longitudinal axis of the fiber. Excepting the case of a hollow filament, the synthetic fiber according to this invention has on any cross-section thereof, no cellular structure in the filled-in and even body material of the fiber. The undulations or recesses are found on the outer or inner surface of the fiber.

The manufacturing material for the improved and modified synthetic fiber according to this invention may be that any of known polymer or copolymer which has a fiber-forming ability. Representative thereof, and in non-limitative sense, it may be of the origin of polyamide, polyester, polyolefine, polyvinylchloride or polyacrylonitrile.

Applicable polyamides may include lactams, linear high polymers as obtainable from diamine and dicarboxylic acid, as being enumerated: nylon 6, nylon 66, nylon 12, nylon 610, nylon 612 and the like which may be grouped as polyamide per se and its copolymer. Applicable polyesters may be, by way of example, polyethylene terephthalate, polyethylene isophthalate and the like which may be grouped in polyester per se and its copolymer with adipic acid, 2-dodecanoic acid, butan diol, polyethylene glycol and the like, said polyesters per se being such linear high polymers as obtainable by condensating reaction between diol and dicarboxylic acid and lacto- or hydroxybenzoic acid.

As may be seen from the foregoing disclosure, the irregular undulations may be provided on the inside of the fiber when it is formed into a hollow configuration, as will become more apparent as the description proceeds. In the case of the hollow structure mode of the fiber, it may have non-closed cross-section at certain, yet randomly selected-out lateral sections of the fiber, so as to establish a pneumatic communication between the interior hollow space of the fiber and the ambient open atmosphere. These communication passages formed through the body of the fiber does not extend along the whole length of the fiber. Therefore, it will be seen that these lateral communication passages have generally different configurations and different circum pherential positions at different cross-sections of the fiber. These communication passages have therefore only short axial distances, thus providing no axially extended slit or slot form.

The term "rayon-like cross-sectional configuration" as used throughout this specification and appended claims has such means that the cross-sectional configuration of the fiber according to this invention as viewed on a microscope represents similar surface undulations as those of the rayon filament. However, the undulations in the case of the invention have a rather profound shade. In the case of the rayon filament, there are only simpler convex and concave undulations, thus representing no deeply coved recesses. The term "coved" means to express a deep "bay"-like recess having a smaller inlet distance than that measured at a deeper and wider place of the recess entered further thereinto from the inlet opening portion thereof. The cross-sectional configuration of the fiber according to this invention, however, represents rather normally such deeply coved recesses. In the similar way, the convexed parts of the undurations as observed on the outer or inner surface of the fiber according to this invention are rather steeper than those appearing on rayon filaments may take frequently pleat-like forms. In comparison with the rayon filaments, the undulations on the fiber according to this invention have generally substantially longer radical lengths, thus having high convex undulations and deeper concave undulations than those on the rayon filaments. In the case of conventional foam yarns, the undulations are generally still shorter and shallower than those of the rayon filaments, the former representing rather shallow crater-like configurations as having formed by the escapement of a gaseous foaming agent.

The novel and peculiar shape and arrangement of the undulations on the fiber according to this invention have a very important role for the fulfilment of the objects of the invention, especially for the realization of an amazingly-increased pick-up ability of human sweat. Other advantages of the invention may also be derived therefrom.

According to the known technique, non-round cross-sectional configuration may be realized by extruding the spinning material through a nozzle having a cross-sectional orifice. In this case, all the the cross-sectional configurations must be same at every sections and the fiber represents longitudinally extended ridges and valleys which are naturally very different in their overall configuration, arrangement and effects, from the undulations formed in accordance with the inventive technique.

According to a prior proposal, textile fabrics are treated with a solvent capable of dissolving partially the constituting fibrous components. By this treatment, the textile fabrics become bulky and softer, by virtue of reduced interyarn pressure. The final products obtained according to this prior proposal is highly difficult to control the treating conditions for the realization of the desired silky and other effects without inviting appreciable detrimental effects upon the strength of the fabrics. In addition, it should be noted that the surface undulations thus formed on the yarn surfaces are very similar to those obtainable with the foam yarn technique and thus highly different from those of the fiber according to this invention.

In order to manufacture the improved and modified fiber according to this invention two different kinds of spinning materials of which the one is capable of being dissolved by contact with a specifically selected solvent are extruded through a spinneret designed and arranged to produce sheath-core type conjugate composite fiber, yet having a turbulence-providing zone, preferably made of a mass of flow-disturbing particles or the like solid members held in position within each of the extrusion orifices of the spinneret, so as to provide modified conjugate fibers, each having complexedly shaped and arranged undulations on and along the conjugating surface between the two different spinning materials now having been conjugated with each other. Then, the thus provided conjugate fibers are treated with the solvent above referred to, so as to dissolvingly remove the sheath component or the core component, as the case may be, which has affinity with the solvent.

In the case wherein the component has been dissolved away, the core component does constitute the physically modified fiber according to this invention so that it is solid or in fullness overall its cross-section and the complexed undulations appear on the outer surface of the fiber.

On the contrary, when the core component has been dissolved out, the fiber will take the form of a hollow fiber which represents the undulations of its inside surface.

The intrinsic viscosity of the spinning material may preferably be about 0.8 – 2.0 for polyamide; and 0.6 – 1.5 for polyester. The volumetric ratio between sheath and core may preferably be 1:5 – 5:1. As the tubulence-providing and flow-resisting material held in position within the extrusion orifice may be sand particles passed through a filter net of 20 – 100 mesh; bearing balls of 0.1 – 2.0 mm dia.; a wire net of 80 – 400 mesh; steel balls, 1 – 2 mm dia. prepared from 0.1 – 1.0 mm $\phi$, stainless steel rod upon cut in lengths; or pervious and resilient resin or the like mass having flow passages, preferably 0.1 – 0.5 mm dia. or width, as the case may be. Naturally, these are only several preferred embodiments of the mass and are not limitative of the invention only thereto.

The temperature of the spinneret may be set to a properly selected one between the softening point and the decomposing point of ether of the two different conjugating materials. Practically, however, it extends between about 200° and 350° C.

As the treating agent for dissolving one of the conjugated components, sulfuric acid, hydrochloric acid, formic acid, phenol, solution of calcium chloride in methanol or the like, for polyamide. Metacresol, aqueous caustic soda solution or the like may preferably be used for polyester. Benzene, xylene, toluene, tetraline or the like may preferably be used for polyolefine.

As the treating conditions, the concentration of solvent may be set to 1 – 100%, as occasion may desire. The treating period may preferably extend for 0.5 second – 120 minutes.

The fibers according to this invention have a specific non-waxy, linen-like hand-feeling and an amazingly improved liquid-absorbing power, at least several or five times, and frequently even ten and several times over conventional nylon filaments as an example, without fear of appreciable loss of fiber strength. Dyestuff affinity and heat-preserving power can be accordingly increased.

These and further objects, features and advantages of the invention will become more apparent when read the following detailed description of the invention by reference to the sole accompanying drawing, in which.

Figure 1:
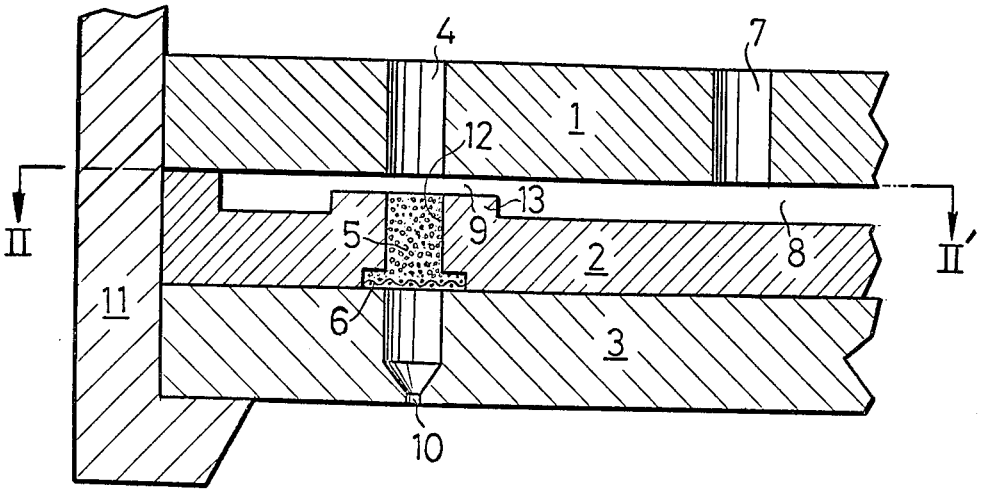
FIG. 1 is a partial and sectional view of a spinneret used for the manufacture of a conjugate fiber as an intermediate product in the manufacturing process.
Figure 2:
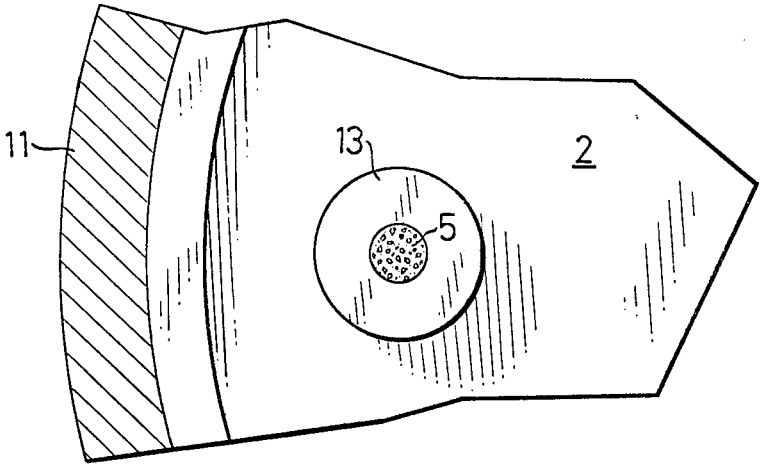
FIG. 2 is a sectional plan view taken substantially along a section line II–II' shown in FIG. 1.

In the spinneret adapted for the preparation of an intermediate product in the form of a two-component conjugate composite fiber shown in FIGS. 1 - 2, numeral 1 represents an upper nozzle plate; 2 an intermediate nozzle plate and 3 a bottom nozzle plate assembled together fixedly as shown and housed in a cup-shaped nozzle holder 11 only partially shown.

Upper nozzle plate 1 is formed with a plurality of first passage openings 4 which are arranged radially on an imaginary circle around the center of the spinneret, although the detaileds have been omitted from the drawing only for simplicity, said first openings 4 being adapted for reception of a first kind of fused polymer for forming the core of the conjugate fiber, as will become more fully as the description proceeds. Second passage openings 7 are also formed through the upper or top nozzle plate 1 and arrange concentrically around the center of the spinneret, although the details have been omitted only for simplicity. These second openings 7 are for the purpose of introducing a second kind of fused spinning material adapted for forming the sheath of the conjugate fiber shown in FIG. 3.

Directly below each of said first passage openings 4, there is provided a passage opening 12 bored through the intermediate nozzle plate 2, a circular and raised shoulder 13 is formed concentrically around each of the passage openings 12, although only one is shown as a representative. The bottom part of each of these openings 12 is enlarged, so as to receive a wire net 6 in position and for preventing a mass of granular- or particle-shaped members, preferably sand particles, bearing balls or the like members as was briefly referred to hereinbefore, so as to provide a turbulence-providing and flow-restricting zone 5 held within the interior space of each of said passage openings 12.

Directly below each of the passage opening 12, there is provided a nozzle orifice 10 having a gradually reducing mode and in concentric arrangement with the intermediate passage opening 12 and bored through the bottom nozzle plate 3. On the upper surface and defined between the top and intermediate plates 1; 2, there is provided a distributing space 8 adapted for distributing the second fused conjugating material received from second passage openings 7 into the intermediate passage openings 12, so as to constitute sheaths, as known per se.

The first fused material is introduced from a first spinning pump, not shown, to each of the first passage openings 4, thence through a reduced part 9 of space 8, the turbulence-providing zone 5 formed within intermediate passage opening 12, wire net 6 and extrusion orifice 10, in the form of a conjugating core.

On the other hand, second fused material is fed from a second spinning pump, not shown, to second passage openings 7, thence through space 8 and its reduced part 9 to each of the said zone 5 and concentrically around the core consisting of the first material. In this way, a sheath is formed during passage through the zone 5, so as to provide a sheath-core type conjugate fiber from each of the intermediate passage openings 12. This conjugate fiber is fed further through the extrusion orifice 10, as commonly known per se.

Figure 3:
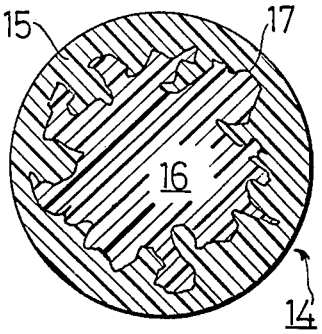
FIG. 3 is a schematic cross-sectional view of the intermediate conjugate composite fiber to be used for the manufacture of the inventive fiber.

By the provision of the said zones 5, however, each of the thus extruded conjugate fibers delivered from the orifices 10 does not take a substantially truely shaped circular sheath and core, yet taking the form as illustrated generally at 14 in FIG. 3. This intermediate fiber product formed into a conjugate composite fiber 14 has heavy undulations on and along the conjugating orifice 17 between the sheath 15 and core 16.

When the sheath 15 has been dissolved out by contact with a dissolving solvent, then the core 16 is isolatedly provided which has on its outer surface heavy undulations 17 of the nature substantially similar to that of a rayon filament. The nature of these undulations has already been disclosed in detail hereinbefore.

On the contrary, when the core 16 has been dissolved out by contact with a dissolving agent, then, the sheath 15 having substantially the conjugated shape is isolatedly provided which has on its inside surface heavy undulations 17' of the nature of which has been described hereinbefore. These undulations 17' are, so to speak, a negative impression of the cross-sectional configuration of that of a rayon filament; yet, however, these undulations can be equally expressed as before to have a cross-sectional configuration similar to that of a rayon filament, because the true relative relation-ship is only in the positive-negative correspondence with each other.

EXAMPLE 1

Polycapramide dissolved in 99%-sulfuric acid and having a relative viscosity: 2.6 (intrinsic viscosity: 1.6) and polyethylene phthalate, [$\eta$]: 0.90, were fused and fed from respective first and second spinning pumps finally through a spinneret of the structure as shown in FIGS. 1 and 2. Polycapramide was used as sheath and polyethylene terephthalate was utilized as core. The volumetric ratio between the sheath material and the core material was set to 1:3.

The spinneret had thirteen extrusion orifices 10, each having 0.5 mm $\phi$.

The zone 5 was constituted by twenty sand particles per extrusion orifice, having passed through a sieve of 20 mesh.

The spinneret temperature was set to 300° C and the winding speed of the produced conjugate fiber was adjusted to 1,000 m/min.

Figure 5:
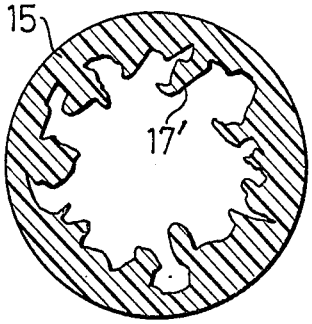

The thus formed and unstretched yarn was stretched as conventionally to its 30-times length into a 50 d/13 fils., polyamide/polyester, sheath-core conjugate yarn which was then treated with an aqueous caustic soda solution for dissolving out the core component. In this way, a hollow yarn as shown in FIG. 5 was obtained, representing random and heavy undulating inside surface 17'.

The dissolvingly treating conditions were:

| | |
|---|---|
| core-dissolving bath: | aqueous 20%-caustic soda solution; |
| bath ratio: | 1:20; |
| bath temp. | 90° C; |
| treating period: | 30 minutes. |

Main physical properties of this yarn were:

| Strength, g/d | Deg. of Elongation, % | Young's modulus, kg/mm$^2$ | Dyeing Ability for acid dyestuff |
|---|---|---|---|
| 4.1 | 37 | 514 | good |

Sweat-absorbing power of the fiber was measured amazingly to about 10 times when compared with that of corresponding plain nylon multifilament. Appearance and feeling were silky and linen-like, respectively.

EXAMPLE 2

50 d/13 fils. - polyester/polyamide sheath-core type conjugate composite yarns were prepared as in the similar way as disclosed hereinbefore by way of Example 1.

Figure 4:
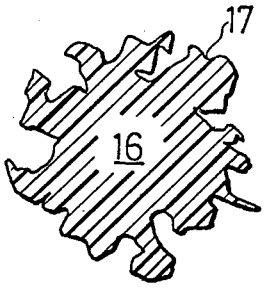
FIGS. 4 and 5 are two different cross-sections of different inventive filaments which have been prepared from the same intermediate product shown in FIG. 3.

These conjugate yarns were treated with an aqueous caustic soda solution continuously and, upon washing with water, solid unified fibers as shown by way of Example in FIG. 4 were provided, upon dissolving out the polyester. The undulations were formed as at 17 in the same figure.

The sheath-dissolving treatment conditions were as follows:

| | |
|---|---|
| treating bath: | 40%-aqueous NaOH solution; |
| bath temp: | 90° C; |
| treating period: | 2 sec. |
| curing: | 180° C for 10 seconds. |

Sweat-absorbing capability was about 8 times that of conventional comparative plain nylon multifilament. Appearance and feeling were silky and linen-like, respectively.

EXAMPLE 3

Polystyrene, having a molecular weight of 200,000, and polyhexamethyleneadipamide dissolved in 95%-sulfuric acid and having a relative viscosity 2.5 and intrinsic viscosity: 1.2, were fused separately and fed from respective spinning pumps to the spinneret shown in FIGS. 1 - 2 and in the vol ratio of 1:3. The extrusion orifices were 130 in number, each having 0.5 mm $\phi$. Polystyrene was used for the sheath and polyhexamethyleneadipamide was utilized for the core.

The zone 5 was filled with 12 sand particles of 30 mesh.

Temperatures of spinneret was set to 280° C and the winding speed was adjusted to 200 m/min.

The unstretched conjugate yarns were stretched to about 2.7-times length, and the stretched filaments were 480 d/120 fils.

These conjugate fibers were treated with benzene, so as to dissolve the sheaths. The resulted yarns were as shown in FIG. 4, as a representative.

Sweat-absorbing capability was about 9-times in comparison with those of conventional comparative plain nylon uarns. Appearance was silky and hand feeling was linen-like.

Sheath-dissolving treating conditions were:

| | |
|---|---|
| bath | benzene; |
| bath ratio: | 1:50; |
| bath temp.: | 60° C; |
| treating period: | 120 mm. |

EXAMPLE 4

$\epsilon$-caprolactam/hexamethylene diadipate copolymerized in wt. ratio of 3:7 and dissolved in 95%-sulfuric acid and having a relative viscosity of 2.6 (intrinsic viscosity: 1.2), and polyethyleneterephthalate, [$\eta$]: 0.70, were fused separately and fed at a vol. ratio, 1:2 from respective spinning pumps to the spinneret, having a similar structure as shown by way example in FIGS. 1 and 2, said spinneret having ten extrusion orifices, each being of 0.25 mm $\phi$, so as to provide sheath-core conjugate yarns. Polyamide copolymer was used for sheath, while polyethyleneterephthalate was utilized for the core.

The zone 5 shown in FIGS. 1 - 2, was filled with eight ball-like members, 1.5 mm $\phi$, made from a length of stainless steel rod, 10 cm long, 0.5 mm $\phi$.

Temperature of spinneret was set to 275° C and the winding-up speed was set to 600 m/min.

The unstretched conjugate yarns were stretched to 3.2-times lengths, to provide yarns of 100 d/10 fils.

These yarns were treated with a sulfuric acid bath, under the following treating conditions.

| | |
|---|---|
| bath: | 70%-aqueous $H_2SO_4$ solution; |
| bath ratio: | 1:30; |
| bath temp. | 50° C; |
| treating period: | 5 min. |

In this way, the sheath was dissolved away, and the thus obtained yarns took a cross-sectional configuration similar to that in FIG. 4 as a representative.

Sweat absorption was 9-times as that of conventional comparative plain nylon multifilaments. Appearance was silky and hand feeling was linen-like.

The embodiments of the invention in which an exclusive property or privilege is claimed are as follows:

1. A method of making an indefinite length synthetic fiber having extreme irregular undulations on its outer surface which vary in cross-section along the entire length of the fiber comprising the steps of:

(a) extruding a first material through a first set of passageways in a spinneret into a distributing space, wherein the first material is selected from the group consisting of polyamide, polyester, polyolefine, polyvinylchloride and polyacrylonitrile, (b) extruding a second material through a second set of passageways in said spinneret into said distributing space, wherein the second material is different from said first material and is selected from the group consisting of polyamide, polyester, polyolefine, polyvinylchloride and polyacrylonitrile, (c) placing said second material concentrically about said first material in said distributing space as said first material exits said first set of passageways, (d) forming extreme, irregular undulations at the interface between the first and second material, by passing the combined first and second material through a turbulence zone, said undulations varying in cross-section along the entire axial length of the material, (e) extruding the combined first and second material through an orifice, and (f) removing said second material from said first material, leaving said first material in fiber form having extreme, irregular undulations along its entire outer suface.

2. A method of making a hollow indefinite length synthetic fiber having extreme irregular undulations on its inner surface, which vary in cross-section along its entire length comprising the steps of:

(a) extruding a first material through a first set of passageways in a spinneret into a distributing space, wherein the first material is selected from the group consisting of polyamide, polyester, polyolefine, polyvinylchloride and polyacrylonitrile, (b) extruding a second material through a second set of passageways in said spinneret into said distributing space, wherein the second material is different from said first material and is selected from the group consisting of polyamide, polyester, polyolefine, polyvinylchloride and polyacrylonitrile, (c) placing said second material concentrically about said first material in said distributing space as said first material exits said first set of passageways, (d) forming extreme, irregular undulations at the interface between the first and second material, by passing the combined first and second material through a turbulence zone, said undulations varying in cross-section along the entire axial length of the material, (e) extruding the combined first and second material through an orifice, and (f) removing said first material from said second material, leaving said second material in fiber form having extreme, irregular undulations along its entire inner surface.

3. The method of claim 2 wherein said first material is removed by dissolving same in a solvent.

4. The method of claim 3 wherein said second material is removed by dissolving same in a solvent.

5. The method of claim 2 comprising the additional step of forming communication passages through the wall of said hollow fiber to allow the interior thereof to communicate with the ambient atmosphere.

* * * * *